US007202826B2

(12) United States Patent
Grant et al.

(10) Patent No.: US 7,202,826 B2
(45) Date of Patent: Apr. 10, 2007

(54) COMPACT VEHICLE-MOUNTED ANTENNA

(75) Inventors: Gary W. Grant, Oregon City, OR (US); Douglas W. Sherman, Auburn, IN (US)

(73) Assignee: Radiall Antenna Technologies, Inc., Vancouver, WA (US)

( * ) Notice: Subject to any disclaimer, the term of this patent is extended or adjusted under 35 U.S.C. 154(b) by 89 days.

(21) Appl. No.: 10/529,024

(22) PCT Filed: Sep. 26, 2003

(86) PCT No.: PCT/US03/30453

§ 371 (c)(1),
(2), (4) Date: Mar. 22, 2005

(87) PCT Pub. No.: WO2004/030143

PCT Pub. Date: Apr. 8, 2004

(65) Prior Publication Data

US 2006/0044196 A1 Mar. 2, 2006

Related U.S. Application Data

(60) Provisional application No. 60/414,606, filed on Sep. 27, 2002.

(51) Int. Cl.
*H01Q 1/32* (2006.01)
*H01Q 1/38* (2006.01)

(52) U.S. Cl. ..... 343/713; 343/711; 343/713; 343/700 MS; 343/846; 343/702; 343/841; 343/767

(58) Field of Classification Search ..... 343/713, 343/711, 700 MS, 702, 841, 846, 750
See application file for complete search history.

(56) References Cited

U.S. PATENT DOCUMENTS

| | | | | |
|---|---|---|---|---|
| 4,535,336 | A | 8/1985 | Shaver | |
| 4,760,402 | A | 7/1988 | Mizuno et al. | |
| 4,868,577 | A | 9/1989 | Wingard | |
| 4,907,006 | A * | 3/1990 | Nishikawa et al. | 343/700 MS |
| 5,177,493 | A | 1/1993 | Kawamura | |
| 5,262,793 | A | 11/1993 | Sperry | |

(Continued)

FOREIGN PATENT DOCUMENTS

| | | |
|---|---|---|
| EP | 001065747 | 1/2001 |

(Continued)

OTHER PUBLICATIONS

Citizen's Band Radio, 3 pages, http://whatis.techtarget.com/definition/0,,sid9_gci341011,00.html (Printed March 17, 2003).

(Continued)

*Primary Examiner*—Tho Phan
*Assistant Examiner*—Chuc Tran
(74) *Attorney, Agent, or Firm*—Klarquist Sparkman, LLP

(57) ABSTRACT

A compact, vehicle-mounted antenna is disclosed. In one embodiment, a first and second antenna element are positioned on a conductive ground plane. The antenna elements can comprise platforms supported by a ground and a feed. The antenna elements can be tuned to various bands (e.g., cellular or PCS). At least one additional antenna element (e.g., a GPS receive antenna) can be positioned between the two antenna elements. One of the feeds of the antenna elements can be angled so that the antenna element has a desired height (e.g., a height matching the other antenna element). The antenna elements can be electrically connected to a transmission line via a single feed line.

41 Claims, 6 Drawing Sheets

U.S. PATENT DOCUMENTS

| | | | | |
|---|---|---|---|---|
| 5,457,467 | A | 10/1995 | Schenkyr et al. | |
| 5,532,709 | A | 7/1996 | Talty | |
| 5,629,712 | A | 5/1997 | Adrian et al. | |
| 5,631,660 | A * | 5/1997 | Higashiguchi et al. | 343/702 |
| 5,812,095 | A | 9/1998 | Adrian et al. | |
| 5,977,919 | A | 11/1999 | Kudo et al. | |
| 6,072,436 | A | 6/2000 | Marougi | |
| 6,133,883 | A * | 10/2000 | Munson et al. | 343/700 MS |
| 6,222,497 | B1 | 4/2001 | Hu et al. | |
| 6,295,030 | B1 | 9/2001 | Kozakai et al. | |
| 6,339,402 | B1 | 1/2002 | McKivergan | |
| 6,369,761 | B1 * | 4/2002 | Thiam et al. | 343/700 MS |
| 6,396,447 | B1 | 5/2002 | Jonasson | |
| 6,411,259 | B1 | 6/2002 | Wendt et al. | |
| 6,429,818 | B1 | 8/2002 | Johnson et al. | |
| 6,448,932 | B1 * | 9/2002 | Stoiljkovic et al. | 343/700 MS |
| 6,542,123 | B1 | 4/2003 | Chen | |
| 6,768,462 | B2 * | 7/2004 | Umehara et al. | 343/700 MS |
| 6,774,849 | B2 * | 8/2004 | Umehara et al. | 343/700 MS |
| 6,850,196 | B2 * | 2/2005 | Wong et al. | 343/702 |
| 6,914,565 | B2 * | 7/2005 | Shikata et al. | 343/700 MS |

FOREIGN PATENT DOCUMENTS

| | | |
|---|---|---|
| JP | 409205311 | 8/1997 |

OTHER PUBLICATIONS

ESMR, 2 pages, http://searchnetworking.techtarget.com/sDefinition/0,,sid7_gci499531,00.html (Printed Mar. 17, 2003).

Specialized Mobile Radio, 2 pages, http://searchnetworking.techtarget.com/sDefinition/0,,sid7_gci499515,00.html (Printed Mar. 17, 2003).

* cited by examiner

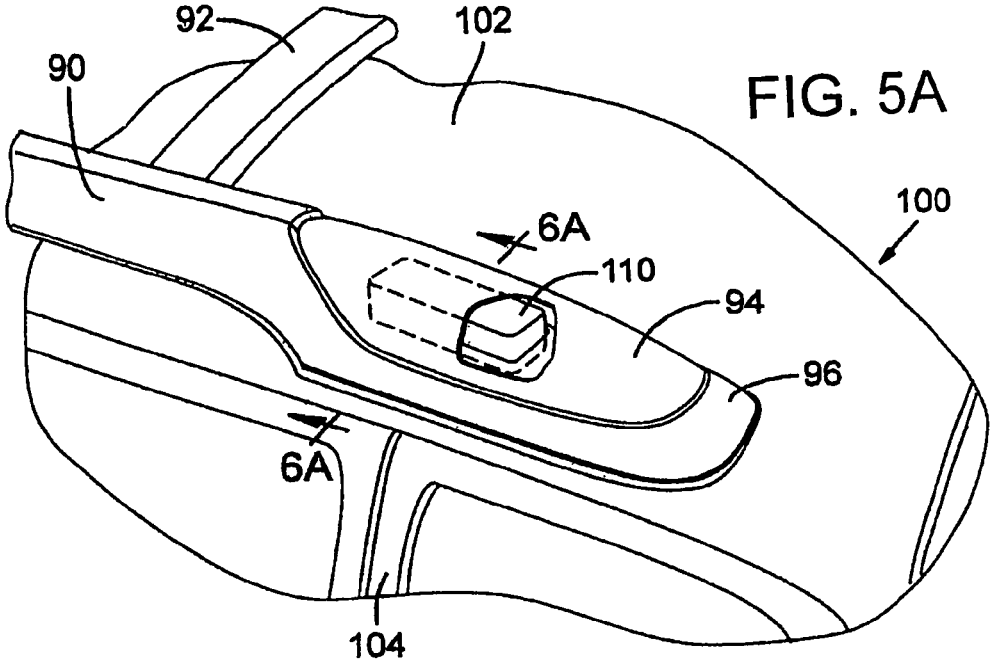
FIG. 5A
FIG. 6A
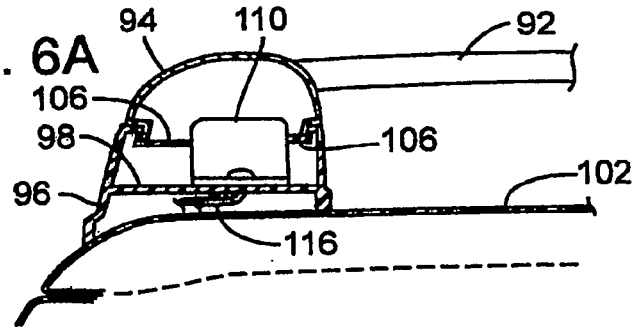

COMPACT VEHICLE-MOUNTED ANTENNA

RELATED APPLICATION

This application is a 371 of PCT/US03/30453 Sep. 26, 2003 which claims the benefit of U.S. Provisional Application No. 60/414,606, filed Sep. 27, 2002, which is incorporated herein by reference.

FILED OF THE INVENTION

The present disclosure relates to a compact antenna. More specifically, the present disclosure relates to a compact antenna that is suitable for use with an onboard wireless voice communications and data system.

BACKGROUND

In recent years, there has been an increasing demand for flexible, multi-functional wireless voice and data systems. In the automobile industry, for instance, new vehicles are often equipped with wireless voice and data systems, which communicate with one or more computers onboard the vehicle and are often referred to as "telematics systems."

A typical telematics system, for example, might provide for wireless telephone services. Currently, two major types of wireless telephone services predominate the market in the United States: the Advanced Mobile Phone Service (AMPS) and the Personal Communication Service (PCS). A telematics system can typically operate using either of the two services depending upon which is available in a particular area. One fundamental difference between the two services, however, is the band in which they operate. AMPS operates in the cellular band between 824 and 894 MHz, whereas PCS operates between 1850 and 1990 MHz. Because each system operates in a different band, separate antennas (sometimes referred to as radiators) are used to transmit and receive the AMPS and PCS signals.

A telematics system might also provide for vehicle positioning information using the Global Positioning System (GPS). By receiving transmissions from orbiting satellites, a GPS receive antenna can determine an automobile's location within a coordinate reference system. Thus, GPS receive antennas can be used in conjunction with an onboard computer to provide a number of driving and mapping services.

As the number of functions performed by onboard telematics systems increases, the number of antennas in the vehicle also increases. Additional antennas, however, are often unsightly and difficult to install, as they may require additional wiring or modification to the vehicle's body panels. Compounding this problem is the automotive industry's increasing emphasis on minimizing the number of parts used in vehicle assembly and on internalizing and integrating such electrical components. Other concerns are aesthetic styling considerations for vehicles and ease of installation, whether as an original-equipment-manufacturer (OEM) part or an after-market part.

These issues and concerns are not limited to the automobile industry. Indeed, the desire to integrate and internalize antennas while maintaining functionality is one present throughout the wireless industries.

SUMMARY

In view of the issues and concerns described above, various embodiments of a compact, vehicle-mounted antenna are described herein. The disclosed features and aspects of the embodiments can be used alone or in various novel and unobvious combinations and sub-combinations with one another.

In one embodiment, an antenna having an antenna element positioned on the upper surface of a base is disclosed. In this embodiment, a conductive material at least partially covers the base, thereby forming a ground plane. The antenna element of this embodiment includes a platform substantially parallel to and spaced apart from the ground plane. The antenna element also includes a ground connecting the ground plane to an end of the platform and a feed connecting the base to the platform. The ground extends substantially perpendicularly from the ground plane, whereas the feed includes a portion that is slanted relative to the base as the feed extends from the base toward the platform. The feed can be angled so that the antenna element has a desired height. For instance, the feed might be angled so that the antenna element is height-matched to the height of another antenna element (e.g., a planar-inverted-F antenna) positioned on the base.

In another embodiment, an antenna having an antenna element coupled to a ground conductor is disclosed. The antenna element includes a platform substantially parallel to and spaced apart from the ground conductor. The platform is supported on the ground conductor by a ground and a feed. In this embodiment, the platform includes a radiating lip that projects outwardly over an edge of the ground conductor by a predetermined distance. By extending the radiating lip beyond the edge of the ground conductor, the lip creates a transition in capacitive coupling with the edge of the ground conductor that contributes to the impedance match of the antenna element. The radiating lip can be selectively adjusted (e.g., by being lengthened, shortened, or bent either upwards or downwards) to impedance match the antenna to a transmission line electrically coupled to the antenna element.

In another embodiment, an antenna element formed from a single conductive strip is disclosed. In this embodiment, the conductive strip is bent and overlapped to form a platform, a sloped segment, and an approximately vertical segment. The conductive strip is further configured to transmit and receive electromagnetic transmissions in a predetermined band.

In another embodiment, a multiband antenna having multiple antenna elements is disclosed. The antenna includes a first antenna element configured to transmit and receive electromagnetic transmissions in a first band, and a second antenna element configured to transmit and receive electromagnetic transmissions in a second band different from the first band. The antenna further includes a conductive feed line electrically coupling a transmission line to a first feed of the first antenna element and a second feed of the second antenna element. The length of the feed line between the first feed and the second feed creates an impedance such that the second antenna element appears to be substantially an open circuit in the first band. Thus, the first and the second antenna elements experience improved electrical isolation from one another.

In another embodiment, a multiband antenna having multiple antenna elements positioned on a base is disclosed. In this embodiment, the base includes a conductive ground surface. A first antenna element positioned on the base is configured to receive and transmit electromagnetic waves in a first band. The first antenna element includes a first platform that is substantially parallel to and spaced apart from the ground surface. The first platform has an inward-facing end and an outward-facing end, which is directed in a first direction. The first platform is supported on the upper surface of the base by a first support and a first feed. The antenna further includes a second antenna element configured to receive and transmit electromagnetic waves in a second band. The second antenna element comprises a second platform, which is substantially parallel to and spaced apart from the ground surface and which also has an inward-facing end and an outward-facing end. Like the first platform, the second platform is supported by a ground and a feed. In this embodiment, the outward-facing ends of the first and second platforms face substantially opposite directions from one another.

The antenna can also include at least one additional antenna element positioned substantially between the first antenna element and the second antenna element on the upper surface of the base. The additional antenna element can be configured to receive and/or transmit electromagnetic waves in one or more additional bands. The additional antenna element can comprise, for instance, a global positioning system (GPS) receive antenna or a satellite radio receiver.

In another embodiment, a vehicle-mounted, communicating antenna having at least three antenna elements is disclosed. The first antenna element is for communicating over a first wavelength range. The second antenna element is for communicating over a second wavelength range different than the first wavelength range. The second antenna element is separated from and in general axial alignment with the first antenna element. The third antenna element is positioned between and in general axial alignment with the first and second antenna elements.

Any of the embodiments disclosed can be utilized in a variety of applications. For instance, any of the embodiments or sub-combinations of the embodiments, can be used as part of an onboard wireless or telematics system in a vehicle. As part of such systems, the embodiments can be positioned in various areas of the vehicle. In one embodiment, for instance, the antenna is positioned within a portion of the roof rack. In another embodiment, the antenna is positioned near the interior rearview mirror assembly and the front windshield of the vehicle.

The foregoing and additional features of the disclosed technology will be more readily apparent from the following detailed description, which proceeds with reference to the accompanying drawings.

BRIEF DESCRIPTION OF THE DRAWINGS

FIG. 5A is a perspective view showing an exemplary embodiment of a vehicle roof rack in which the antenna of FIG. 1 is integrated.

FIG. 6A is a cross-section in elevation of a first representative embodiment of the vehicle roof rack and antenna of FIG. 5A.

DETAILED DESCRIPTION

Disclosed below are representative embodiments that are not intended to be limiting in any way. Instead, the present disclosure is directed toward novel and unobvious features and aspects of the embodiments of the compact antenna described below. The disclosed features and aspects of the embodiments can be used alone or in various novel and unobvious combinations and sub-combinations with one another.

Figure 1:
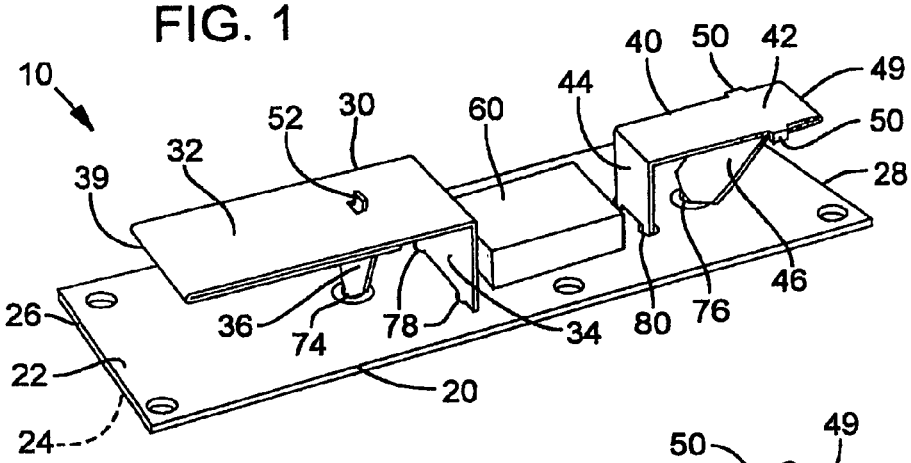
FIG. 1 is a first perspective view of an exemplary compact, multiband antenna showing three antenna elements mounted to a base.

FIGS. 1–4 show an exemplary embodiment of a compact, multiband antenna 10. As best shown in FIG. 1, the antenna 10 includes antenna elements 30, 40, 60, which are positioned on a base 20. As illustrated, the antenna elements 30, 40, 60 are aligned along a longitudinal axis, e.g., a central axis of the base 20. The illustrated base 20 has two substantially planar surfaces: an upper surface 22, and a lower surface 24. The illustrated base 20 also has lateral edges 26, 28.

In the illustrated embodiment, the base 20 is formed from a printed circuit board (PCB), which is largely made of an insulative material. In this embodiment, the upper surface of the PCB is coated with a suitable conductive material (e.g., copper, tin, etc.), which forms an electrical ground plane on the upper surface 22. The illustrated base 20 has a rectangular shape, but can be formed into a variety of different shapes depending on the location in which the antenna 10 is placed or on the particular application for which the antenna 10 is used.

Antenna element 30 is a first antenna element positioned on the upper surface 22 of the base 20. In the illustrated embodiment, the antenna element 30 includes a platform 32 positioned above and spaced apart from the ground plane. The platform 32 shown in FIG. 1 is located in a plane substantially parallel to the ground plane and the upper surface 22. Although the illustrated platform 32 has a generally rectangular shape, the shape of the platform 32 is not limited and can be altered by one of ordinary skill in the art to achieve a variety of performance characteristics (e.g., wider or narrower bandwidth, etc.). For example, the width of the platform 32 can be decreased in order to tune the antenna element 30 to a narrower bandwidth. Moreover, the platform 32 can include a variety of additional design features known in the art that impact the antenna element's transmitting and receiving characteristics. For example, the platform 32 can include various apertures or notches that affect the performance of the antenna element 30.

The antenna element 30 further includes a ground 34 and a feed 36. In the illustrated embodiment, the ground 34 and the feed 36 comprise single support structures or posts. In other designs, however, multiple grounds or feeds can be utilized. The ground 34 shown in FIG. 1 is located substantially at an inward-facing end of the platform 32 and extends generally perpendicularly from the upper surface to the platform 32. The ground 34 is electrically coupled, via solder or other suitable means, to the ground plane on the upper surface 22 of the base 20. As shown more clearly in FIG. 2, the ground 34 can include pegs 35 that help affix the antenna element 30 to the base 20 at apertures 78. As illustrated, the pegs 35 can be formed, e.g., as a single piece, with the ground 34.

Figure 2:
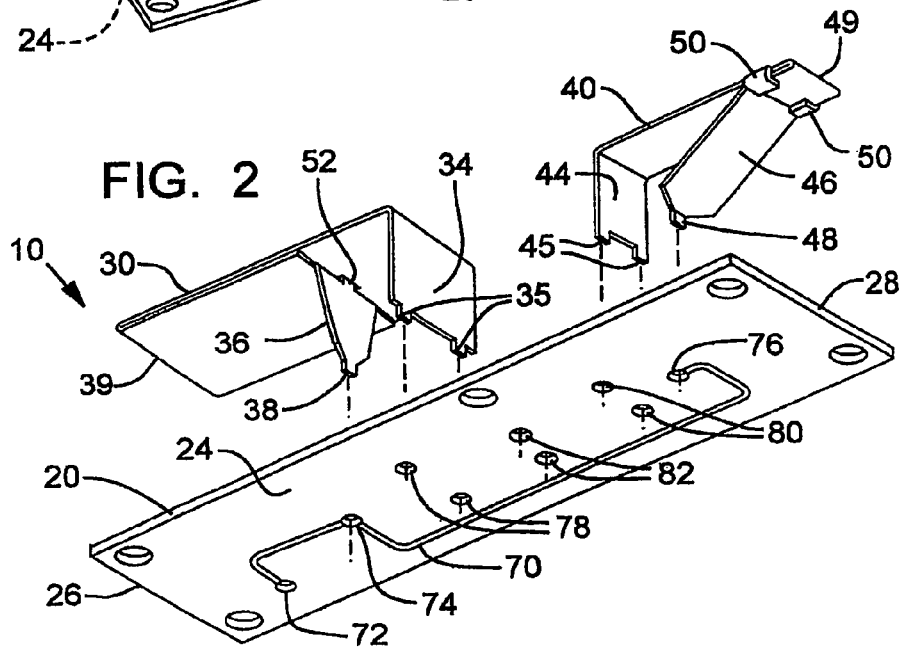
FIG. 2 is an assembly view of the antenna of FIG. 1 from a bottom perspective view showing the feed line on the bottom surface of the base and two of the antenna elements in their relation to the base.

The feed 36 is spaced apart from the ground 34 and, in the illustrated embodiment, similarly extends generally perpendicularly from the upper surface 22. As shown in FIG. 2, the feed 36 tapers to a feed point 38. The feed point 38 does not contact the ground plane on the upper surface 22, but instead connects to the lower surface 24 through a via 74 or a suitable aperture. More specifically, in the illustrated embodiment, the ground plane on the upper surface 22 does not cover the area immediately adjacent the feed point 38 and the via 74.

In the illustrated embodiment, the antenna element 30 is a quarter-wave that has a relatively uniform gain in the 360 degrees around the antenna's horizon. The antenna element 30 is configured to transmit and receive electromagnetic signals in a first band. In the illustrated embodiment, for example, the antenna element 30 is configured to operate in the cellular band, which is between 824 and 894 MHz. In comparison with the other communication bands (e.g., PCS), the wavelength of the cellular band is relatively large and, generally speaking, requires a larger antenna element. Moreover, an antenna element configured for the cellular band typically requires a larger ground plane than an antenna element for a smaller-wavelength band.

In the illustrated embodiment, the antenna element 30 is positioned substantially toward the lateral edge 26 of the base 20 (in FIG. 1, toward the right edge of the base 20). The antenna element 30 is positioned so that an outward-facing edge 39 of the platform 30 does not extend beyond the lateral edge 26 of the base 20. More specifically, the antenna element 30 is positioned so that the area of the ground plane beneath the platform 32 is sufficiently large for the antenna element 30 to operate effectively in the cellular band. The particular tuning of the antenna element 30, however, is not limited to the cellular band. Instead, the antenna element 30 can be tuned for a variety of other bands or standards, including, but not limited to: AMPS, PCS (Personal Communication System), TACS (Total Access Communication System), NMT (Nordic Mobile Telephone), IS-54/-136 (North American Digital Cellular), IS-95 (North American Digital Cellular), GSM (Global System for Mobile Communications), DSC18000, PDC (Personal Digital Cellular), CDPD (Cellular Digital Packet Data), RAM-Mobitex, Ardis-RD-LaP, Bluetooth, or IEEE 802.11.

The illustrated antenna element 30 is sometimes referred to as a planar-inverted-F antenna, or "PIFA," because of its structural resemblance to the letter "F" on its side (see, e.g., FIG. 2). The shape of the antenna 30 is not limiting, however, and can be modified in a number of ways without sacrificing its compact design. For instance, the angles of the feed 36 and the ground 34 relative to the platform 32 and to the upper surface 22 can be altered. Likewise, the locations of the feed 36 and the ground 34 can be adjusted in a variety of different ways. For instance, one of ordinary skill in the art might adjust the height of the antenna element 30 (i.e., the distance between the platform 32 and the ground plane) in order to increase or decrease the radiation resistance or to fit the antenna within a certain space.

Figure 3:
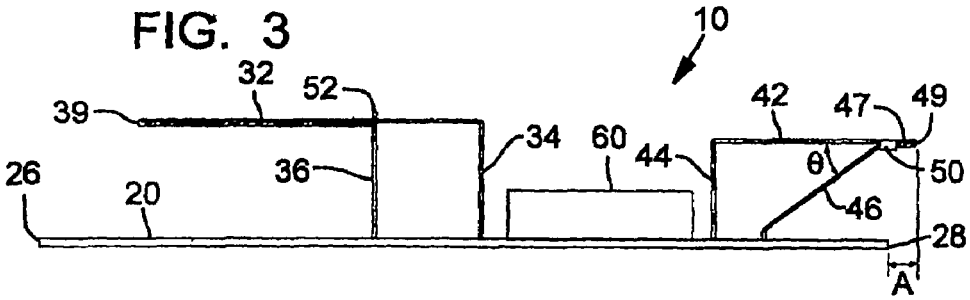
FIG. 3 is a side elevational view of the antenna of FIG. 1

As shown in FIG. 1–3, antenna element 40 is a second antenna element positioned on the upper surface 22 of the base 20. In the illustrated embodiment, the antenna element 40 includes a platform 42 positioned above and spaced apart from the ground plane. The platform 42 shown in FIG. 1 is located in a plane substantially parallel to the ground plane on the upper surface 22. Although the illustrated platform 42 has a generally rectangular shape, this shape is not limited and can be altered as described above to achieve a variety of performance characteristics or to include a variety of additional design features.

Like the antenna element 30, the antenna element 40 includes a ground 44 and a feed 46. In the illustrated embodiment, the ground 44 and the feed 46 comprise single support structures. In other designs, however, multiple ground posts or feed posts can be utilized. The ground 44 shown in FIG. 1 is located at an inward-facing end of the platform 40 and extends perpendicularly from the upper surface 22 of the base 20. The ground 44 is electrically coupled, via solder or other suitable means, to the ground plane on the upper surface 22. As shown more clearly in FIG. 2, the ground 44 can also include pegs 45 that help attach the antenna element 40 to the base 20 through apertures 80.

As shown in FIG. 3, the feed 46 of the illustrated embodiment is spaced apart from the ground 44 and includes a portion that angles away from the ground as it extends from the upper surface 22 to the platform 42. As shown in FIG. 3, for instance, the feed 46 forms an angle θ with the platform 42 as it extends from the upper surface 22. In the illustrated embodiment, the feed 46 intersects the platform 42 at a location of the platform 42 near an edge 49, thereby forming a lip portion 47. Further, as shown in FIG. 2, the feed 46 tapers to a feed point 48. The feed point 48 does not directly contact the ground plane on the upper surface 22, but instead connects to the lower surface 24 of the base 20 through a via 76. By angling the feed 46, the height of the platform 42 can be increased when compared to the height of an equivalently tuned PIFA without detuning the antenna from its desired band or substantially altering the performance of the antenna element 40. The increased height of the platform 42 allows the antenna element 40 to have a higher radiation resistance, thereby radiating more energy into the free space around the antenna element 40. In one particular embodiment, the platform 42 and the platform 32 are "height matched" such that they are approximately the same height (e.g., differing by no more than about 25–30%) such that the overall dimensions of the antenna can be kept compact Alternatively, the height of the antenna element 40 can be adjusted to other desired heights. Additional adjustments known in the art may need to be made to the antenna element 40 in order to maintain the tuning of the antenna element 40 in the desired band (e.g., narrowing the platform 42).

In the illustrated embodiment, antenna element 40 is configured to operate in a second band higher than the first band (i.e., a band with higher frequencies than the first band). For example, the antenna element 40 can be configured to transmit and receive electromagnetic signals in the PCS band, which is between 1850 and 1990 Mhz. On account of the antenna element 40 being tuned for a higher frequency, the antenna is generally smaller than the antenna element 30. However, as discussed above, the height of the antenna element 40 can be maximized by angling the feed post 46 without diminishing the antenna element's overall performance. The antenna element 40 can also be tuned for a variety of other bands or standards, including, but not limited to: AMPS, TACS, NMT, IS-54/-136, IS-95, GSM, DSC18000, PDC, CDPD, RAM-Mobitex, Ardis-RD-LaP, Bluetooth, or IEEE 802.11.

In the embodiment illustrated in FIGS. 1–4, the first antenna element 30 is positioned substantially toward the lateral edge 26 of the base 20 (in FIG. 1, toward the left edge of the base 20), and the second antenna element 40 is positioned substantially toward lateral edge 28 of the base 20 (in FIG. 1, toward the right edge of the base 20). The antenna elements 30, 40 of the illustrated embodiment are also positioned so that edges 39, 49 of the platforms 32, 42, respectively, face substantially opposite directions. In one particular implementation of this embodiment, platform edges 39, 49 are positioned so that they are at substantially the farthest possible points from one another allowed by the base 20 and the ground plane. In this implementation, the mutual coupling between the two antenna elements is effectively reduced.

In the particular embodiment illustrated in FIGS. 1–4 and as best shown in FIG. 3, the antenna element 40 is positioned on the upper surface 22 of the base 20 so that the lip portion 47 projects beyond the edge 28 of the base 20 by a distance A. In this embodiment, the capacitance between the antenna element 40 and the ground plane is more sensitive to changes in the antenna element 40 design and in the positioning of the antenna element 40. This increased sensitivity results from the transition in capacitance created between the lip portion 47 and the fringe field at the edge 28 of the ground plane. Accordingly, the capacitance of the antenna element 40, which partially contributes to the impedance match of the antenna element 40, can be adjusted by moving the antenna element 40 farther from or closer to the edge 28 of the ground plane (e.g., by lengthening, shortening, or bending the lip portion 47 or antenna element 40 either upward or downward). In other embodiments, however, the antenna element 40 is positioned so that the lip portion 47 does not project beyond the edge 28, or so that the first antenna element 30 has a portion of the platform 32 that projects beyond the edge 28 of the base 10. Typically, however, the antenna element that is tuned for the higher-frequency band is better suited for such positioning because a smaller ground plane can be used to effectively operate the antenna element.

The exact dimensions of the antenna elements 30, 40 can vary widely and are not limited to those shown in the figures. Instead, the dimensions of antenna elements 30, 40 may depend on the space in which the antenna 10 is positioned or on the relative placement of other components on the antenna 10. Moreover, the antenna elements 30, 40 can be formed using a variety of construction methods. In the illustrated embodiment, for instance, the antenna elements 30, 40 are formed from single strips of conductive material. The conductive material can be any suitable conductor, but in one particular embodiment comprises brass, and can be coated with another material (e.g., tin). Further, the conductive material can have a thickness (e.g., 0.02 inches) and malleability that allows the material to be bent and shaped. In one embodiment, for example, the antenna elements 30, 40 are originally elongated, flat, substantially rectangular strips that have the grounds 34, 44 shaped at one end and the feeds 36, 46 shaped at the other. The strips are then bent and folded to form the antenna elements 30, 40. One or more folding tabs 50 (one being shown on the antenna element 30 in FIG. 2) can be used to secure the antenna elements 30, 40 into their final shape. Additionally, the strip can include a tongue and slot combination 52 (shown on antenna element 40 in FIG. 2) to further secure the antenna elements 30, 40 into their final shape. This particular method of construction is not limiting, however, and a number of other methods known in the art can be used (e.g., casting, forging, milling, etc.).

Figure 4:
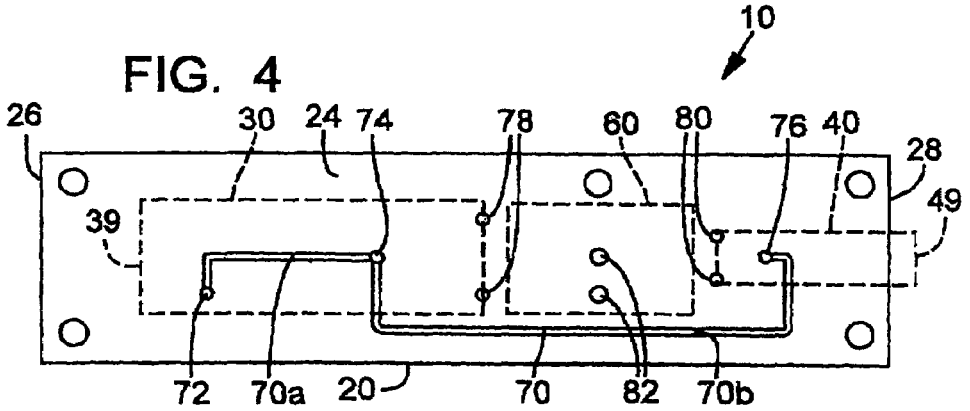
FIG. 4 is a bottom plan view of the antenna of FIG. 1.

FIG. 4 is a bottom view of the base 20 of the antenna 10 showing the feed line 70 that is used to electrically connect the first antenna element 30 and the second antenna element 40 to the transmission line (not shown). In the illustrated embodiment, the feed line 70 comprises a microstrip trace on the bottom of the PCB that forms the base 20. The feed line 70 originates at a transmission line connection 72 that electrically couples the feed line 70 to the transmission line. The transmission line can be a coaxial cable that carries the relevant signal (e.g., an analog RF signal) and can be connected to a variety of electrical components that process and produce the signal, including, but not limited to, an onboard computer, telephone system, or other central control circuit. The illustrated feed line 70 is designed to feed both antenna elements 30, 40, thereby reducing the number of wires that need to be routed and connected to the antenna 10. Thus, for instance, if the antenna 10 is used in a motor vehicle, antenna elements 30, 40 can be driven using a single transmission line, thereby simplifying the installation process and minimizing the overall amount of wiring in the vehicle.

As shown in FIG. 4, the feed line 70 is electrically coupled to the first antenna element 30 at a first feed point 74, and to the second antenna element 40 at a second feed point 76. Thus, the illustrated feed line 70 is separable into a first segment 70A between the transmission line connection 72 and the first feed point 74, and a second segment 70B between the first feed point 74 and the second feed point 76. The illustrated feed line 70 can be designed to facilitate impedance matching of the antenna elements 30, 40 so that they are independent of each other as much as possible. For example, in order to achieve a desired electrical isolation, the length of the second segment 70B (i.e., the distance between the first feed point 74 and the second feed point 76) can be adjusted to a length such that the antenna element 40 for the second band presents what appears to be substantially an open circuit at the frequency of the first antenna element 30. For example, in one embodiment where the antenna elements 30, 40 are tuned to the cellular and PCS bands, respectively, the cellular antenna element 30 looks like a short circuit in the PCS band, and the PCS antenna element 40 looks like an open circuit in the cellular band. In one particular implementation of this embodiment, the length of the segment 70B is an odd multiple of a quarter wavelength at cellular frequencies, thereby transforming the short circuit presented by the PCS antenna element 40 into an open circuit. This feed-line length creates acceptable impedance matches for both antenna elements 30, 40, even though they share a common transmission line. Because of spatial considerations on the base 20, a length of three-fourths of a wavelength can be used. In other embodiments, a different feed-line length may be required to transform the impedance to an open circuit in the desired band. The feed-line length for a particular application will vary depending on a number of factors, including, for example, the frequency band for which the antenna elements are tuned and the size and type of material used for the base.

The feed line 70 can be further modified to create an impedance match with the antenna elements 30, 40. For example, the width of the feed line 70 can be selected to achieve a desired impedance (e.g., 50 Ohms). As understood by one of ordinary skill in the art, the size and shape of the antenna elements 30, 40 may need to be adjusted in order to account for the impedance created by the feed line 70. Further, although the feed line 70 in FIGS. 2 and 4 is shown on the bottom of the PCB board, the feed line 70 and the transmission line can be located on the top of the base 20. In other embodiments, the antenna elements 30, 40 can be driven by multiple feed lines, or additional antenna elements can be included on the base 20 and driven by the single transmission line 70, which can be adjusted according to the principles described above.

As shown in FIGS. 1–3, antenna element 60 is a third, or additional, antenna element positioned on the upper surface 22 of the base 20. The third antenna element 60 can be connected to the upper surface 22 with an adhesive or other suitable means. In the illustrated embodiment, antenna element 60 comprises a global positioning system (GPS) module comprising a GPS receive antenna and amplifier. Antenna element 60, however, can comprise a variety of other antennas or electrical components. For instance, antenna element 60 can be an antenna for various other applications, including, but not limited to: satellite radio, PCS, AMPS, TACS, NMT, IS-54/-136, IS-95, GSM, DSC18000, PDC, CDPD, RAM-Mobitex, Ardis-RD-LaP, Bluetooth, or IEEE 802.11. In the illustrated embodiment, antenna element 60 is positioned on the board 20 between the first antenna element 30 and the second antenna element 40. In this position, the third antenna element 60 experiences improved electrical isolation from the antenna elements 30, 40, and the platform edges 39, 49, which tend to be active areas of radiation on the platforms 32, 42. Also, isolation between first antenna element 30 and the second antenna element 40 improved by their being separated from one another on the base 20.

In the illustrated embodiment, the third antenna element 60 is electrically coupled to a separate transmission line (not shown) independent of the feed line 70. The transmission line for the third antenna element 60 can be connected to the third antenna element 60 via apertures 82 shown in FIGS. 2 and 4. Accordingly, in the illustrated embodiment, the antenna 10 is connected to two separate transmission lines. The illustrated arrangement with the third antenna element 60 is not limiting, however, and various other arrangements are possible. For example, multiple additional antennas can be positioned on the base 20 at various locations around or between antenna elements 30, 40. These additional antennas can be used for a variety of applications, such as those listed above.

Figure 8:
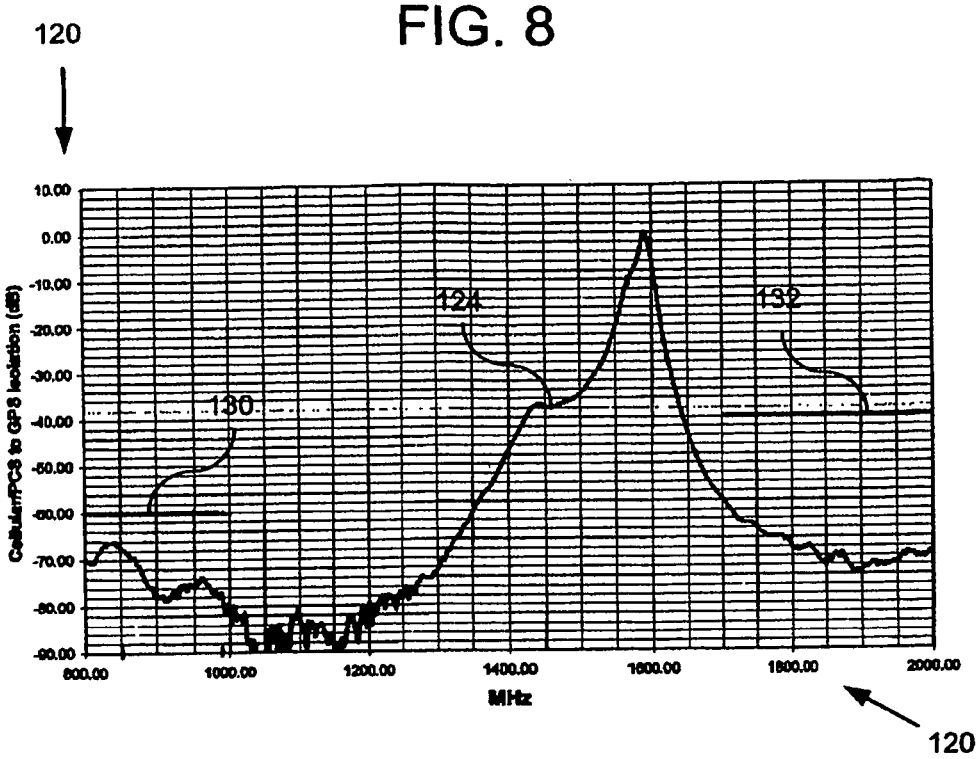
FIG. 8 is a graph showing the electrical isolation between antenna elements of the exemplary antenna shown in FIG. 1.

FIG. 8 shows a graph of the electrical isolation exhibited in an exemplary antenna 10. The exemplary antenna 10 is substantially identical to the one illustrated in FIGS. 1–4. The first antenna element 30 of the exemplary antenna 10 is tuned for the cellular band (i.e., substantially between 824–894 Mhz), and the second antenna element 40 for the PCS band (i.e., substantially between 1850–1990 Mhz). The third antenna element 60 of the exemplary antenna 10 is a GPS receive antenna. Vertical axis 120 of the graph delineates the amount of electrical isolation in decibels of the first and second antenna elements 30, 40 versus the third antenna element 60 (labeled on FIG. 8 as "Cellular/PCS to GPS Isolation (dB)"). Horizontal axis 122 delineates the frequency tested in MHz. Plotted line 124 shows the results of the test for the exemplary antenna 10. A first benchmark 130 is shown in the cellular frequency range as having an electrical isolation limit of −60 dB. The first benchmark 130 represents a desired electrical isolation such as may be required by an automobile manufacturer or other manufacturer with whose products the antenna 10 might be used. A second benchmark 132 is shown in the PCS frequency range as having an electrical isolation limit of −40 dB. Like the first benchmark 130, the second benchmark 132 represents a desired electrical isolation such as may be required by a product manufacturer. As can be seen by plotted line 124, the electrical isolation of the exemplary antenna 10 is well within the limits set by the first and second benchmarks 130, 132, indicating that the antenna 10 exhibits better-than-desired electrical isolation in the PCS and cellular bands. At certain frequencies between the first and second benchmarks 130, 132, however, the exemplary antenna 10 experiences less isolation. Because the exemplary antenna 10 is designed to operate in the PCS and cellular bands, however, the suboptimal isolation at other frequencies is of no importance.

The antenna 10 described above can be utilized for a variety of applications in which it is desirable to have a compact antenna. For instance, the antenna 10 can be used as part of a telematics system in an automobile. On account of its compact design, the antenna 10 can be located in numerous areas of the vehicle, including areas hidden from view of the driver, passenger, and/or outside onlookers.

Figure 6B:
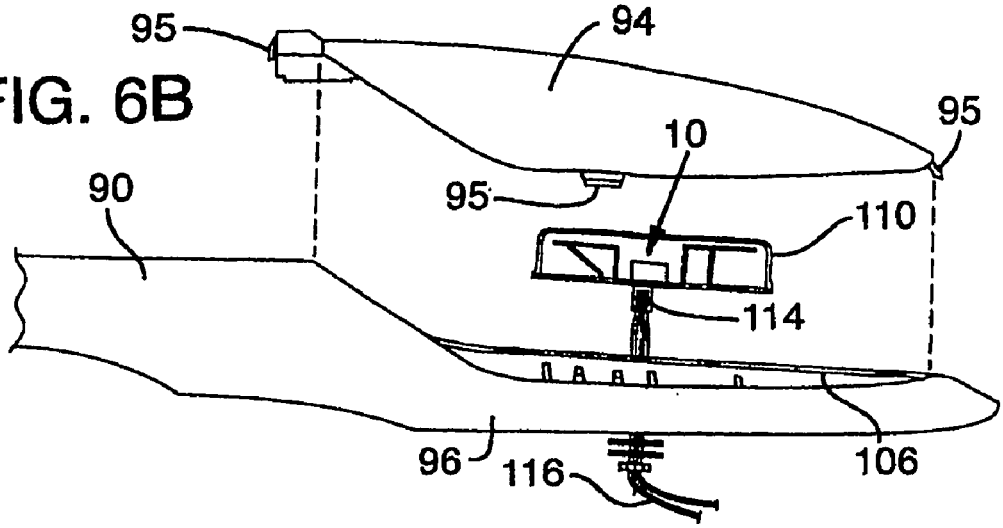
FIG. 6B is an exploded side view in elevation of the roof rack and antenna of FIG. 6A.
Figure 6C:
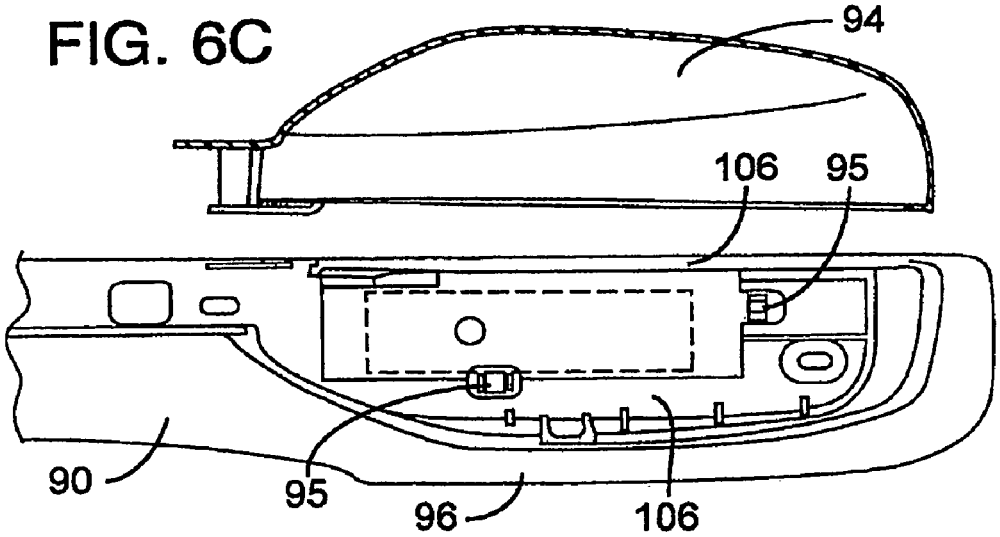
FIG. 6C is a top plan view of a base portion and a bottom plan view of a cover portion of the roof rack of FIG. 6A.
Figure 7:
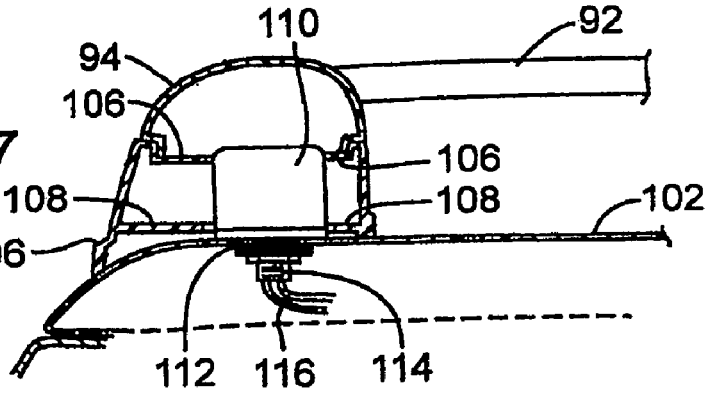
FIG. 7 is a cross-section of an integrated vehicle roof rack and antenna assembly according to a second representative embodiment in which the antenna is coupled to the vehicle and the roof rack is in an overlying relationship with the antenna.

In the embodiment illustrated in FIGS. 5–7, for instance, the antenna 10 is positioned within a roof rack of an automobile. FIG. 5A shows a perspective view of one particular embodiment of the antenna 10 integrated into a roof rack 90. As is well known in the art, the roof rack 90 is mounted onto an exterior roof panel 102 of an automobile 100. FIG. 5A shows the roof rack 90 as it terminates near the right, front corner of the roof panel 102. Also shown in FIG. 5A is a top of a passenger door 104. The roof rack 90 includes a base portion 96 and a cover portion 94. In the illustrated embodiment, the cover portion 94 is detachably connected to the base portion 96. Together, the cover portion 94 and the base portion 96 form a compartment within which the antenna housing 110 is positioned, as shown through the partial cutaway in the cover portion 94. The antenna housing 110 can comprise a plastic housing that houses the antenna 10 according to one of the embodiments described above. The antenna housing 110 can be sealed, except for an antenna housing aperture (not shown) through which the transmission line(s) extend. The antenna housing 110 serves to provide additional support to the antenna 10 and offers increased protection from outside elements that might otherwise harm the antenna 10. The roof rack 90 can be constructed from a hard plastic, or other suitably sturdy material, and can further comprise cross beams 92 on which various loads can be secured. The exact dimensions and shape of the roof rack 90 can vary widely depending on the particular application and vehicle.

The distance between the antenna housing 110 and the roof panel 102 can vary from vehicle to vehicle. For instance, in some implementations, the roof panel 102 can be constructed from a metal that forms a capacitive coupling with the antenna elements 30, 40, 60 of the antenna 10. In these embodiments, the base portion 96 of the roof rack 90 can be formed to hold the antenna housing 10 at a distance above the roof panel 102 sufficient to facilitate optimizing the impedance match. Alternatively, the roof panel 102 can be used to form part of the ground plane with which the antenna elements 30, 40, 60 interact.

Figure 5B:
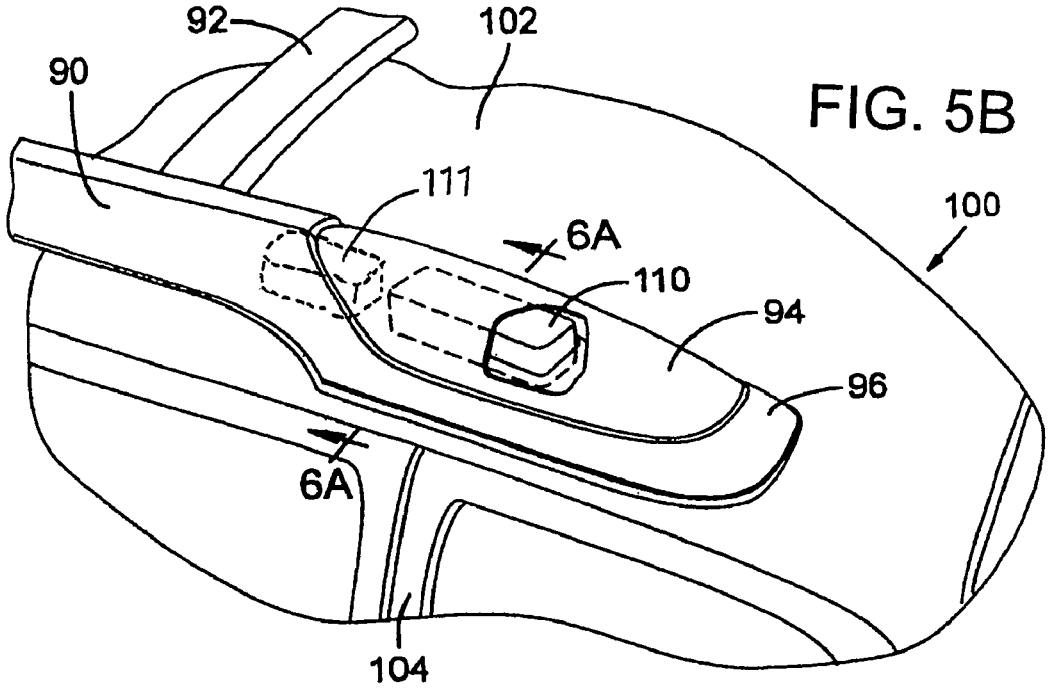
FIG. 5B is a perspective view showing an alternative embodiment of the integrated roof rack and antenna of FIG. 5A.

FIG. 5B illustrates another embodiment of the integrated roof rack 90. In this embodiment, an additional antenna housing 111 is positioned within the compartment formed between the cover portion 94 and the base portion 96. In the illustrated embodiment, the additional antenna housing 111 is positioned behind the antenna housing 110, but in other embodiments can be positioned in a variety of locations in the roof rack 90. The additional antenna housing 111 can comprise any of the disclosed antennas or any other suitable antenna, and can be coupled with the telematics or other electronic system of the vehicle in any of the manners described below. For example, antenna housing 111 can contain a Bluetooth or IEEE 802.11 antenna configured to communicate with a local-area network. Thus, the antenna in the antenna housing 111 can operate in conjunction with an onboard computer to perform electronic business transactions (e.g., make payments at a gas station or toll booth) or to transfer information (e.g., downloading or uploading digital videos, music, or other data (including, for example, vehicle diagnostic data)) wirelessly.

In other embodiments, a plurality of additional antenna housings 111 are included in the roof rack 90. The additional antenna housings 111 can be located in a variety of locations in the roof rack 90 (e.g., in a portion of the roof rack 90 at an opposite side of the roof panel 102). In still other embodiments, any or all of the antennas located within the roof rack 90 are not separately enclosed within an antenna housing. Further, as more fully described below with respect to the antenna housing 110, any of the additional antenna housings can be installed during the actual assembly of the vehicle or at a post-assembly installation point (e.g., a vehicle dealership). Thus, the additional antenna housing 111 can be one of many possible modules that can be installed, swapped, replaced, or removed from the roof rack 90. This modular approach creates a wide range of possible antenna configurations, which can be individually specified by the manufacturer, dealer, or purchaser.

Two representative implementations of the integrated roof rack 90 and antenna 10 are shown in FIGS. 6A–C and 7. FIG. 6A shows a cross section of a first representative implementation at a location on the roof rack 90 indicated by arrows 6A in FIG. 5A. FIG. 6B shows a side view of the first representative implementation. FIG. 6C shows a top view of the roof rack 90 according to the first representative implementation. The cover portion 94 includes a support portion 98 on which the antenna housing 110 is placed. The transmission line(s) 116 coupled to the antenna 10 pass through an aperture of the support portion 98. The base portion 96 further includes ridges 106 that help position the antenna housing 110. The cover portion 94 can attach to the base portion 96 via frictional tongues 95 and slots (not shown). Alternatively, the cover portion 94 can be attached to the base portion 96 by threaded fasteners or other suitable means. The base portion 96 can also include an extension 114 that extends through an aperture in the roof panel 102 and further secures the base portion 96 to the roof panel 102. The extension 114 can have a hollow interior through which the transmission line(s) extend and can be a threaded fastener (e.g., a threaded rivnut).

In the first implementation illustrated in FIGS. 6A–C, the antenna housing 110 is positioned above and out of direct contact with the roof panel 102. During assembly of the vehicle, the roof rack 90 of this implementation can be positioned and secured to the roof panel 102 prior to the insertion and wiring of the antenna housing 110. Consequently, the antenna housing 110 can be inserted and wired during the actual assembly of the vehicle, or, in one particular embodiment, at a post-assembly installation point. For instance, the vehicle 100 can be assembled to have a roof rack 90 and transmission line end(s) that extend through the roof panel 102 into the enclosure of the roof rack 90 designed for the antenna housing 110. A customer can then choose among a variety of different antenna housings 110, each offering a different combination of antennas and features, and have the selected antenna housing 110 installed, updated, or replaced. Because the internal wiring is already in place, installation of the selected antenna housing 110 is greatly simplified and can be performed without any additional modifications to the vehicle.

FIG. 7 shows a second representative implementation of the integrated roof rack 90 and antenna 10. In the embodiment shown in FIG. 7, the antenna housing 110 directly contacts the roof panel 102 of the vehicle 100. The lower base portion 96 of the roof rack 90 does not include a support portion 98, but instead includes an opening along the bottom of the roof rack 90 configured to receive the antenna housing 110. In the illustrated embodiment, for instance, the lower base portion 96 includes ridges 106, 108 that surround and position the antenna housing 110 within the roof rack 90. The antenna housing 110 can include an antenna housing aperture (not shown) positioned adjacent to a roof panel aperture 112. The transmission line(s) 116 can pass from an interior space in the vehicle (e.g., the headliner), through the roof panel aperture 112, and into the antenna housing 110 where the transmission line(s) 116 are coupled to the antenna 10. The antenna housing 110 can also include an extension 114 positioned around the antenna housing aperture. The extension 114 can be a hollow, threaded fastener (e.g., a threaded rivnut) that allows passage of the transmission line(s) and secures the antenna housing 110 to the roof panel 102. In one particular implementation, the roof panel aperture 112 is formed during assembly of the vehicle, and the antenna housing 110 is secured to the aperture 112. When installed on the roof panel 102, the roof rack covers and protects the antenna housing 110. A variety of different roof racks 90 can be used to cover the antenna housing 110.

The embodiments of the roof rack 90 described above are not limiting, and can be modified in a number of ways. For instance, the antenna 10 may not be enclosed within an antenna housing 110. Instead, the antenna 10 can be coupled directly to the base portion 96 or to the roof panel 102. Alternatively, the antenna housing 110 can be located in another area of the roof rack. For example, the antenna housing 110 might be located toward the back end of the roof rack 90. Moreover, the roof rack 90 can include multiple antenna housings 110, each of which comprises a different combination of antennas 10 or antenna elements.

Figure 9:
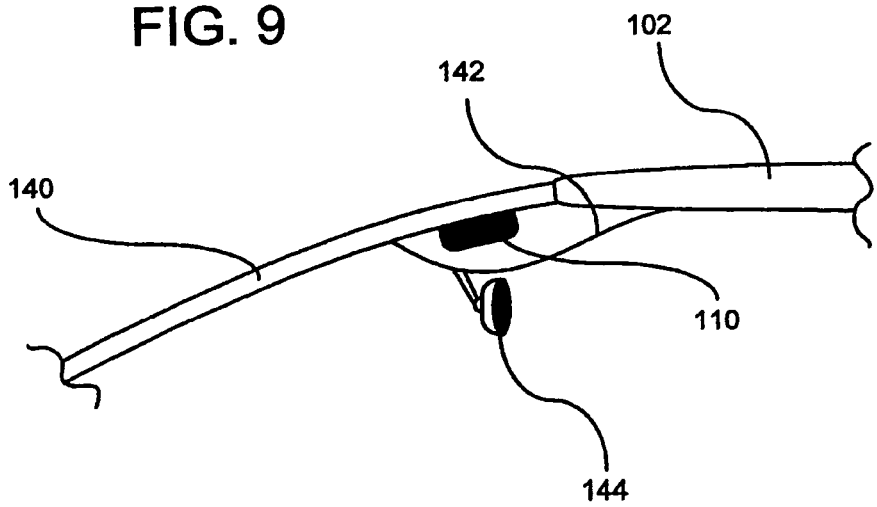
FIG. 9 is a cross-section schematically showing an exemplary embodiment of a vehicle interior in which the antenna of FIG. 1 is positioned between a windshield and a rearview mirror of the vehicle.

FIG. 9 shows an embodiment in which the antenna 10 is located in a housing 110 that is positioned near a rearview mirror 144 and a front windshield 140 of a vehicle. In the particular embodiment illustrated in FIG. 9, for instance, the antenna housing 110 is located in a portion of the headliner 142 that extends over a portion of the front windshield 140 and the roof panel 102. This embodiment is not limiting, however, and the antenna housing 110 can be located in other structures or enclosures adjacent to the rearview mirror 144. In one alternative embodiment, for instance, the antenna 10 is located in the housing containing the rearview mirror 144.

In view of the many possible implementations, it will be recognized that the illustrated embodiments include only examples and should not be taken as a limitation on the scope of the disclosed technology. Rather, the disclosed technology is defined by the following claims. We therefore claim all embodiments that come within the scope of these claims.

What is claimed is:

1. A compact, vehicle-mounted antenna, comprising:

a base having an upper surface, the upper surface of the base being at least partially covered with a conductive material, thereby forming a ground plane; and an antenna element positioned on the upper surface of the base, the antenna element comprising:

a platform substantially parallel to and spaced apart from the ground plane, a ground connecting the ground plane to an end of the platform, the ground extending from the ground plane at an angle substantially perpendicular to the upper surface of the base, and a feed connecting the base to the platform, a portion of the feed being slanted relative to the base as the feed extends from the base toward the platform, wherein the angle of the feed is adjusted so that the antenna element has a desired height.

2. The antenna of claim 1, wherein a distance between the ground plane and the platform is larger than a corresponding distance in an equivalent planar-inverted-F antenna.

3. The antenna of claim 1, wherein the antenna element is configured to transmit and receive electromagnetic waves in a band substantially between about 1850 and about 1990 MHz.

4. The antenna of claim 1, wherein the end of the platform is an inward-facing end, the platform further comprising an opposite outward-facing end that extends beyond an edge of the base.

5. The antenna of claim 4, wherein the outward-facing end forms a capacitive coupling with a fringe field at the edge of the ground plane.

6. The antenna of claim 1, wherein the antenna element is a first antenna element, the platform is a first platform, the ground is a first ground, and the feed is a first feed, the antenna further comprising:

a second antenna element positioned on the upper surface of the base, the second antenna element comprising:

a second platform substantially parallel to and spaced apart from the ground plane, a second ground connecting the ground plane to an end of the second platform, and a second feed connecting the upper surface of the base to the second platform.

7. The antenna of claim 6, wherein the first and second antenna elements are positioned on opposite halves of the base.

8. The antenna of claim 7, wherein the first and second antenna elements have outward-facing ends that are directed substantially parallel to, but opposite of each other.

9. The antenna of claim 6, wherein the first and second antenna elements are substantially height matched.

10. The antenna of claim 1, wherein the antenna is positioned within and enclosed by a housing, the housing being located near a rearview mirror assembly of a vehicle.

11. A compact, vehicle-mounted antenna, comprising:

a base having an upper surface, the upper surface of the base being at least partially covered with a conductive material, thereby forming a ground planet; and an antenna element positioned on the upper surface of the base, the antenna element comprising:

a platform substantially parallel to and spaced apart from the ground plane, a ground connecting the ground plane to an end of the platform, the ground extending from the ground plane at an angle substantially perpendicular to the upper surface of the base and a feed connecting the base to the platform, a portion of the feed being slanted relative to the base as the feed extends from the base toward the platform, wherein the antenna is positioned within a portion of a roof rack of a vehicle.

12. The antenna of claim 11, wherein the antenna is enclosed within an antenna housing, and the roof rack portion has a recess shaped to receive the antenna housing when the roof rack and the antenna housing are installed.

13. A compact, vehicle-mounted antenna, comprising:

a ground conductor; and an antenna element coupled to the ground conductor, the antenna element having a platform substantially parallel to and spaced apart from the ground conductor, the platform having a radiating lip that projects outwardly over an edge of the ground conductor by a predetermined distance, the platform being supported above the ground conductor by a ground and a feed, wherein the radiating lip forms a capacitive coupling with the edge of the ground conductor, the capacitive coupling partially contributing to an impedance of the antenna element.

14. The antenna of claim 13, wherein the predetermined distance is selected to partially contribute to the impedance of the antenna element such that the impedance creates an impedance match with a transmission line electrically coupled to the antenna element when the antenna element is tuned to a desired frequency.

15. A compact, vehicle-mounted antenna, comprising:

a first antenna element configured to transmit and receive electromagnetic transmissions in a first band, the first antenna element having a first feed;

a second antenna element configured to transmit and receive electromagnetic transmissions in a second band different than the first band, the second antenna element having a second feed; and a conductive feed line electrically coupling a transmission line to the first feed and the second feed, wherein a length of the feed line between the first feed and the second feed creates an impedance such that the second antenna element appears to be substantially an open circuit in the first band.

16. The antenna of claim 15, further comprising at least one additional antenna positioned substantially between the first antenna element and the second antenna element, the additional antenna being configured to at least one of receive and transmit electromagnetic transmissions in one or more additional bands.

17. The antenna of claim 16, wherein the at least one additional antenna is a global positioning system (GPS) receive antenna.

18. The antenna of claim 15, wherein the first and second antenna elements are attached to a base, and wherein one of the first and second antenna elements has a radiating lip that projects beyond the base.

19. The antenna of claim 15, wherein the feed line has a width selectively adjusted to match the impedance of a transmission line electrically coupled to the feed line.

20. The antenna of claim 15, wherein the first band is between about 824 and about 894 MHz, and the second band is between about 1850 and about 1990 MHz.

21. The antenna of claim 15, wherein the antenna is positioned within a portion of a roof rack of a vehicle.

22. The antenna of claim 21, wherein the antenna is enclosed within an antenna housing that positioned within the roof rack portion.

23. The antenna of claim 15, wherein the antenna is positioned within and enclosed by a housing, the housing being located near a rearview mirror assembly of a vehicle.

24. A vehicle-mounted, multiband antenna, comprising:

a base having a conductive ground surface;

a first antenna element positioned on the base and being configured to receive and transmit electromagnetic radiation in a first band, the first antenna element comprising a first support, a first feed, and a first platform substantially parallel to and spaced apart from the ground surface, the first platform having an inward-facing end and an outward-facing end;

a second antenna element positioned on the base and being configured to receive and transmit electromagnetic radiation in a second band different than the first band, the second antenna element comprising a second support, a second feed, and a second platform substantially parallel to and spaced apart from the ground surface, the second platform also having an inward-facing end and an outward-facing end, the first and second antenna elements being positioned on the base such that the outward- facing ends of the first and second antenna elements face substantially opposite directions; and at least one additional antenna element positioned substantially between the first antenna element and the second antenna element, the additional antenna element being configured to receive and/or transmit electromagnetic radiation in one or more additional bands.

25. The antenna of claim 24, wherein the first antenna element and the second antenna element are positioned in axial alignment with one another.

26. The antenna of claim 24, wherein the first feed and the second feed are electrically coupled to a transmission line via a single feed line.

27. The antenna of claim 26, wherein the single feed line is located on the lower surface of the base, and wherein a segment of the feed line between the first feed and the second feed creates an impedance such that the second antenna element appears to be substantially an open circuit in the first band.

28. The antenna of claim 24, wherein a portion of the second feed of the second antenna element is angled such that the second antenna element has a desired height and remains configured to transmit and receive electromagnetic radiation in the second band.

29. The antenna of claim 28, wherein the second antenna element is height matched with the first antenna element.

30. The antenna of claim 28, wherein the angled portion of the second feed is angled away from the second support.

31. The antenna of claim 28, wherein the first antenna element is a planar- inverted-F antenna.

32. The antenna of claim 24, wherein the additional antenna element is a global positioning system (GPS) receive antenna.

33. The antenna of claim 24, wherein the additional antenna element is a satellite radio receiver.

34. The antenna of claim 24, wherein the first band is substantially between about 824 and about 894 MHz, and the second band is substantially between about 1850 and about 1990 MHz.

35. The antenna of claim 24, wherein the outward-facing end of the second antenna element extends beyond an edge of the ground surface and forms a capacitor with the edge of the ground plane, the capacitance of the capacitor contributing to an impedance of the second antenna element.

36. The antenna of claim 35, wherein the capacitance is selectively adjusted to create an impedance match with a transmission line.

37. The antenna of claim 24, wherein the antenna is positioned within a portion of a roof rack of a vehicle.

38. The antenna of claim 37, wherein the antenna is enclosed within an antenna housing that is positioned within the roof-rack portion.

39. The antenna of claim 24, wherein the antenna is positioned within and enclosed by a housing, the housing being located near a rearview mirror assembly of a vehicle.

40. A vehicle-mounted, communicating antenna, comprising:

a first antenna element for communicating over a first wavelength range;

a second antenna element for communicating over a second wavelength range different from the first wavelength range, the second antenna element being separated from and in general axial alignment with the first antenna element; and a third antenna element positioned between and in general axial alignment with the first and second antenna elements, and the first and second antenna elements are tuned, shaped, and/or positioned relative to each other to reduce loss of performance, wherein the first and second antenna elements are oppositely oriented to increase electrical isolation relative to each other;

wherein the first and second antenna elements are tuned, shaped, and/or positioned relative to each other to reduce loss of performance.

41. The antenna of claim 40, wherein the signals from the first and second antenna elements are communicated as analog signals via a single transmission line to a circuit within the vehicle.

* * * * *

UNITED STATES PATENT AND TRADEMARK OFFICE

CERTIFICATE OF CORRECTION

PATENT NO. : 7,202,826 B2
APPLICATION NO. : 10/529024
DATED : April 10, 2007
INVENTOR(S) : Gary W. Grant and Douglas W. Sherman It is certified that error appears in the above-identified patent and that said Letters Patent is hereby corrected as shown below:

In the Specification:

Column 6, line 37, "through a via 76." should read --through 76.--.

Column 6, line 49, "compact Alternatively" should read --compact. Alternatively--.

Column 9, line 32, "element 40 improved" should read --element 40 is improved--.

Column 10, line 57, "antenna housing 10" should read --antenna housing 110--.

In the Claims:

Column 13, line 59, "ground planet;" should read --ground plane;--.

Column 13, line 67, "base and" should read --base, and--.

Column 14, line 66, "that positioned" should read --that is positioned--.

Signed and Sealed this

Eighth Day of July, 2008

JON W. DUDAS
*Director of the United States Patent and Trademark Office*